US010322914B2

(12) United States Patent
Wimmer

(10) Patent No.: US 10,322,914 B2
(45) Date of Patent: Jun. 18, 2019

(54) CRANE SOCKET FOR A LOADING CRANE

(71) Applicant: Palfinger AG, Salzburg (AT)

(72) Inventor: Eckhard Wimmer, Hallein (AT)

(73) Assignee: Palfinger AG, Salzburg (AT)

( * ) Notice: Subject to any disclaimer, the term of this patent is extended or adjusted under 35 U.S.C. 154(b) by 0 days.

(21) Appl. No.: 15/235,459

(22) Filed: Aug. 12, 2016

(65) Prior Publication Data

US 2016/0347589 A1 Dec. 1, 2016

Related U.S. Application Data

(63) Continuation of application No. PCT/AT2015/000019, filed on Feb. 9, 2015.

(30) Foreign Application Priority Data

Feb. 14, 2014 (AT) ..... GM66/2014

(51) Int. Cl.

| | |
|---|---|
| ***B66C 23/44*** | (2006.01) |
| ***F42B 3/103*** | (2006.01) |
| ***F42B 3/195*** | (2006.01) |
| ***F42B 3/198*** | (2006.01) |

(52) U.S. Cl.

CPC ..... *B66C 23/44* (2013.01); *F42B 3/103* (2013.01); *F42B 3/195* (2013.01); *F42B 3/198* (2013.01)

(58) Field of Classification Search

CPC ..... B66C 23/44; F42B 3/103; F42B 3/195; F42B 3/198

See application file for complete search history.

(56) References Cited

U.S. PATENT DOCUMENTS 2,369,816 A * 2/1945 Crawford ..... B66C 23/44 212/204
2,957,678 A * 10/1960 Jones ..... B66C 23/44 254/105
3,795,332 A 3/1974 Eriksson
3,998,414 A 12/1976 Palmcrantz (Continued)

FOREIGN PATENT DOCUMENTS

CN 1923664 3/2007
CN 101607574 12/2009

(Continued)

OTHER PUBLICATIONS

International Search Report dated May 19, 2015 in International (PCT) Application No. PCT/AT2015/000019.

(Continued)

*Primary Examiner* — Saul Rodriguez
*Assistant Examiner* — Ashley K Romano
(74) *Attorney, Agent, or Firm* — Wenderoth, Lind & Ponack, L.L.P.

(57) ABSTRACT

The invention relates to a crane socket for a loading crane, including a base part which has a bearing region for bearing the rotatable part of a loading crane, at least one support part which is used to additionally support the crane socket on a substructure, and a joint which connects the base part to the at least one support part. The joint is a torsionally flexible support, in which a first end of the support is connected to the base part, and a second end of the support is connected to the at least one support part.

4 Claims, 4 Drawing Sheets

(56) References Cited

U.S. PATENT DOCUMENTS

| | | | | |
|---|---|---|---|---|
| 7,328,810 | B1 | 2/2008 | Rhodes | |
| 2007/0045212 | A1 | 3/2007 | Riedinger et al. | |
| 2015/0274087 | A1* | 10/2015 | Yorke Roe | B60R 9/10 414/462 |

FOREIGN PATENT DOCUMENTS

| | | |
|---|---|---|
| DE | 1 229 263 | 11/1966 |
| FR | 2 138 848 | 1/1973 |
| FR | 2 289 429 | 5/1976 |
| JP | 60-19590 | 2/1985 |
| RU | 67082 | 10/2007 |

OTHER PUBLICATIONS

Search Report dated Nov. 26, 2014 in Austrian Application No. GM 66/2014, with English translation.
Search Report dated Apr. 25, 2017 in corresponding Chinese Application No. 201580008308.3.
Opposition against European Patent No. 3 105 164 B1 mailed Jun. 26, 2018.
Spare Parts Catalogue of the HIAB type 193 loader, Jun. 1969.
"HIAB LKW-Kran Typ 193, Betriebsanleitsun", Handbook for a HIAB crane type 193.
Photos showing various views of the crane base from an Exhibition at HIAB in Hudsvail, Sweden; and photos from the Internet showing HIAB crane 193.
Brochure HIAB 193, Apr. 1967.

* cited by examiner

CRANE SOCKET FOR A LOADING CRANE

BACKGROUND OF THE INVENTION

The present invention concerns a crane base for a loading crane, and a loading crane and a motor vehicle having such a loading crane.

Crane bases are arranged in the central region of a non-rotatable part of a loading crane. Arranged in a base part (generally in the form of a transverse beam member) of the crane base is a mounting region for the rotating part of the loading crane. The mounting arrangement for the rotating part of the loading crane is generally implemented with two vertically offset displaced radial bearings and an upwardly or downwardly disposed thrust bearing (generally plain bearings). The slewing drive (for example: a toothed rack slewing drive) for the rotatable part of the loading crane is generally also disposed in or on the base part.

The crane base is also the connecting element in relation to the substructure (generally of a motor vehicle, for example a truck) and is fixed (generally by way of outwardly disposed plate members by screws) to the substructure by way of at least one support portion (generally a so-called "auxiliary frame"), by way of a fixing region.

The substructure, that is to say for example the truck chassis, is not to be inadmissibly deformed or stressed by the loading crane or the crane base which is fitted in place by the base part and the at least one support portion.

To achieve a statically determinate application of force, a journal pin is arranged between the base part and the at least one support portion (see FIG. 1). The at least one support portion which is mounted by a round mounting pin ("rocker pin") is frequently referred to as the "rocker" and has a horizontal axis.

The carrier for the mounting pin has a closed (torsionally stiff) cross-sectional shape. Both the base part and also the rocker are rigidly connected to the auxiliary frame substructure, but can rotate relative to each other about the horizontal axis (rocker axis). As a result, the system is statically determinate. FIG. 1 shows a crane base 1 of the general kind set forth, in accordance with the state of the art, having a journal pin joint 4 between the base part 2 and the at least one support portion 3. Another known form of construction is a rigid, one-piece structure for the crane base without the above-described rotary joint (FIG. 2). The profile shape of the carrier between the base part and the at least one support portion in relation to the substructure is usually implemented with a closed (torsionally stiff) box cross-section. FIG. 2 shows a crane base 1 in accordance with the state of the art but not of the general kind set forth, in which the carrier 9 between the base part 2 and the at least one support portion 3 is torsionally stiff. Known profile cross-sections of known torsionally stiff carriers 9 are shown in FIGS. 4*a* through 4*c*.

As the application of force to the at least one support portion and by way of same to the substructure is in that case statically indeterminate, the substructure can be inadmissibly stressed.

The removal of the rotary joint means that this structure is admittedly simpler and less expensive, but is in particular often not desired by the manufacturers of motor vehicles.

SUMMARY OF THE INVENTION

The object of the invention is to provide a crane base, a loading crane, and a motor vehicle having a loading crane, which are indeed statically determinate but which are simpler and less expensive to produce than the above-discussed structure using a rotary joint.

The invention does not provide an additional journal pin joint between the base part and at least one support portion. Due to the torsionally flexible carrier which can be integrated into the steel construction of the crane base, the joint function is implemented even without the journal pin joint of the state of the art.

The joint function can be effected, for example, by way of an open carrier structure (for example, having an "I-profile structural configuration") in the region in which the journal pin joint would usually be disposed. An open I-profile cross-section of suitable length is distinguished by a low level of torsional or rotational stiffness, but high flexural stiffness. The slight rotational movements which occur can therefore be passed by way of the carrier without the carrier being thereby statically overloaded (by torsion). The transmission of all other forces or moments in operation of the crane is unrestrictedly possible. The function of such a structure is practically identical to that with "rocker pins", but can be produced with a lower level of complication and expenditure.

BRIEF DESCRIPTION OF THE DRAWINGS

Further details of the state of the art and of the invention can be seen in the Figures, in which.

DETAILED DESCRIPTION OF THE INVENTION

Figure 3:
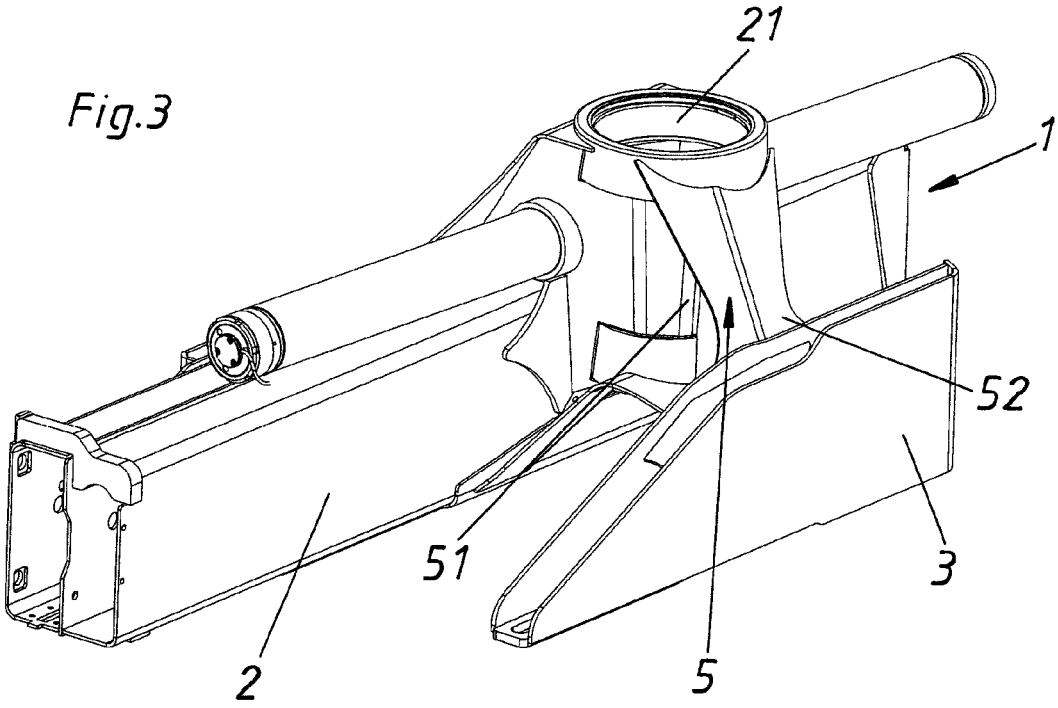
FIG. 3 shows an embodiment of the invention.
Figure 4F:
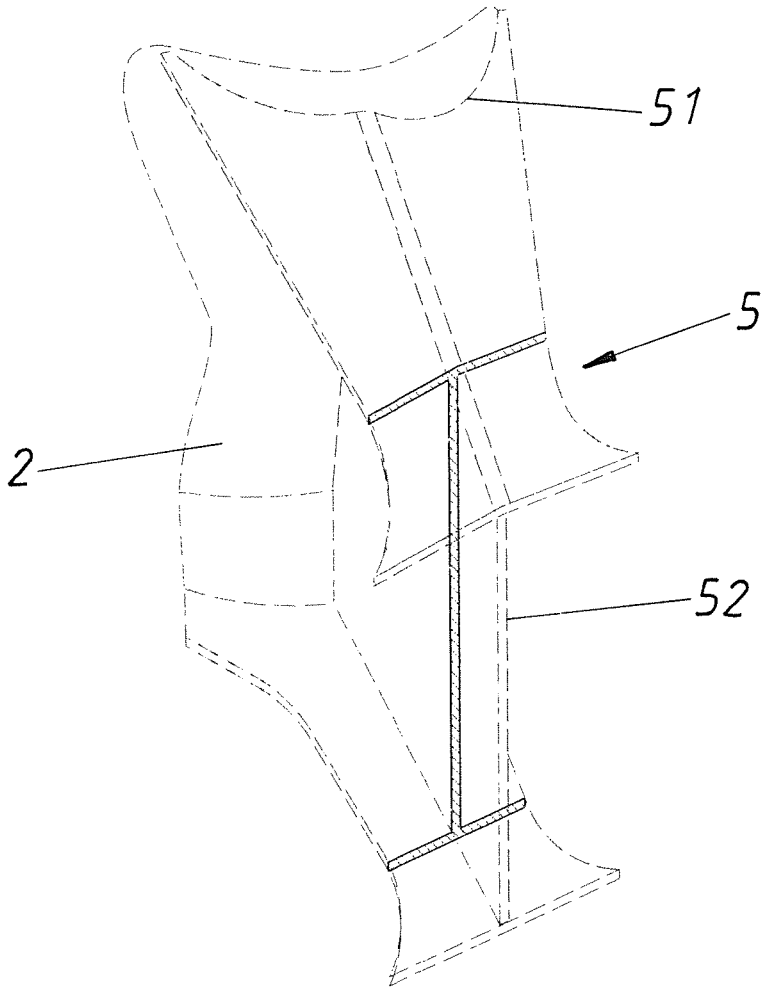
FIG. 4*f* is a perspective view of the carrier belonging to the profile cross-section shown in FIG. 4*e*.
Figure 5:
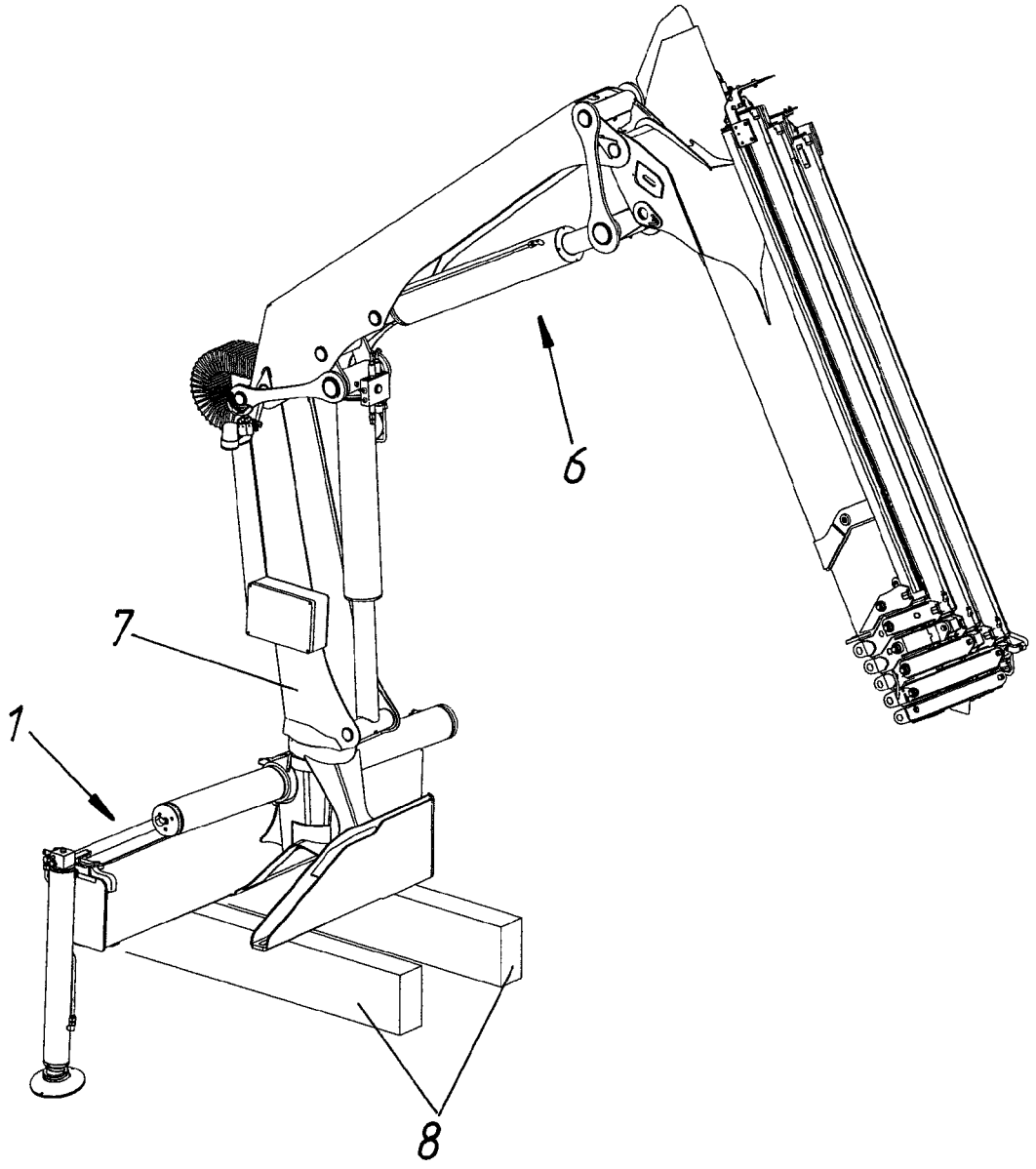
FIG. 5 is a perspective view of a loading crane according to the invention together with substructure.

FIG. 3 shows an embodiment of a crane base 1 according to the invention. The base part 2 has a mounting region 21 for mounting the rotating part 7 of a loading crane 6 (see FIG. 5). The base part 2 and the at least one support portion 3 are connected by a joint in the form of a torsionally flexible carrier 5 (see FIG. 4*f*), in which a first end 51 of the carrier 5 is connected (directly attached) to the base part 2 and a second end 52 of the carrier 5 is connected (directly attached) to the at least one support portion 3. There is no rotary joint between the base part 2 and at least one support portion 3. The necessary rotatability of the base part 2 and at least one support portion 3 is afforded solely by the torsionally flexible carrier 5.

Figure 1:
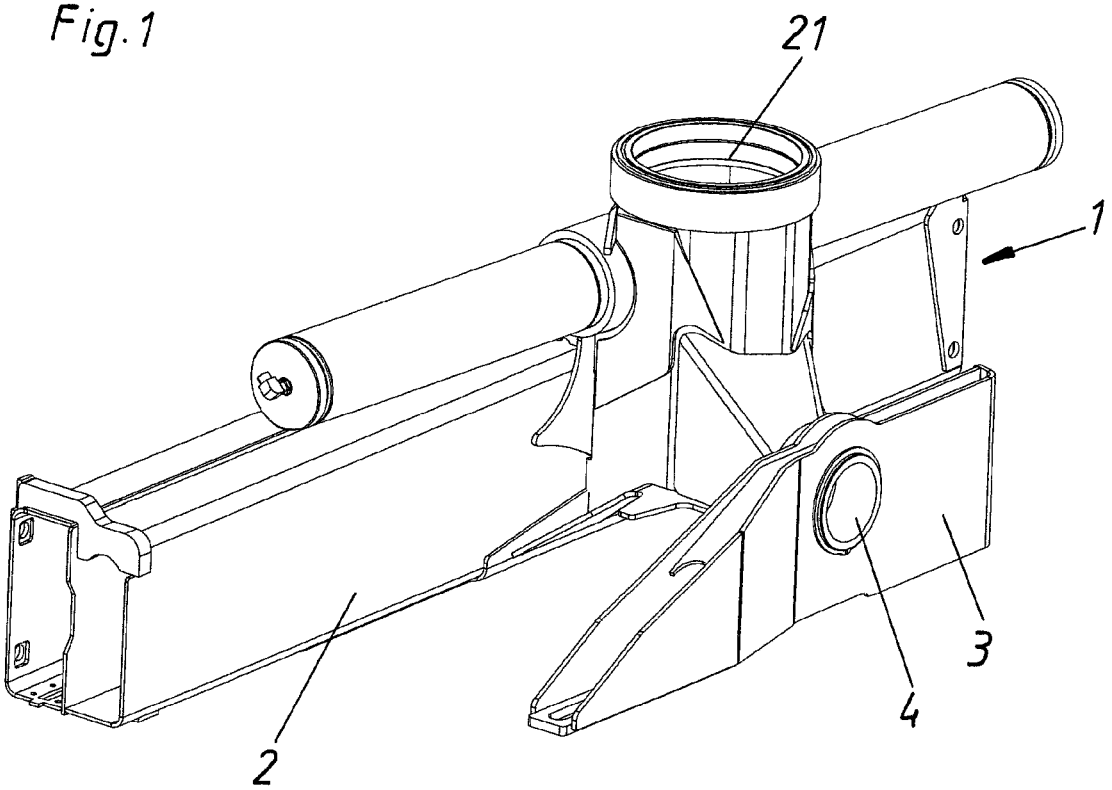
FIG. 1 shows a first solution according to the state of the art with a rotary joint.
Figure 4A:
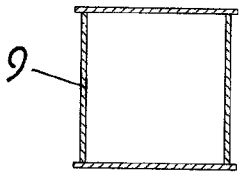
FIGS. 4*a*-4*c* show profile cross-sections according to the state of the art.
Figure 4B:
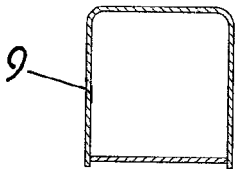
Figure 4C:
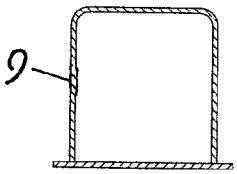
Figure 4D:
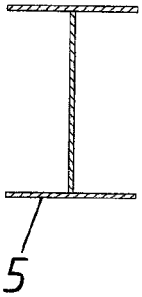
FIGS. 4*d* and 4*e* show profile cross-sections according to the invention.
Figure 4E:
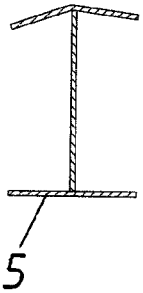
Figure 2:
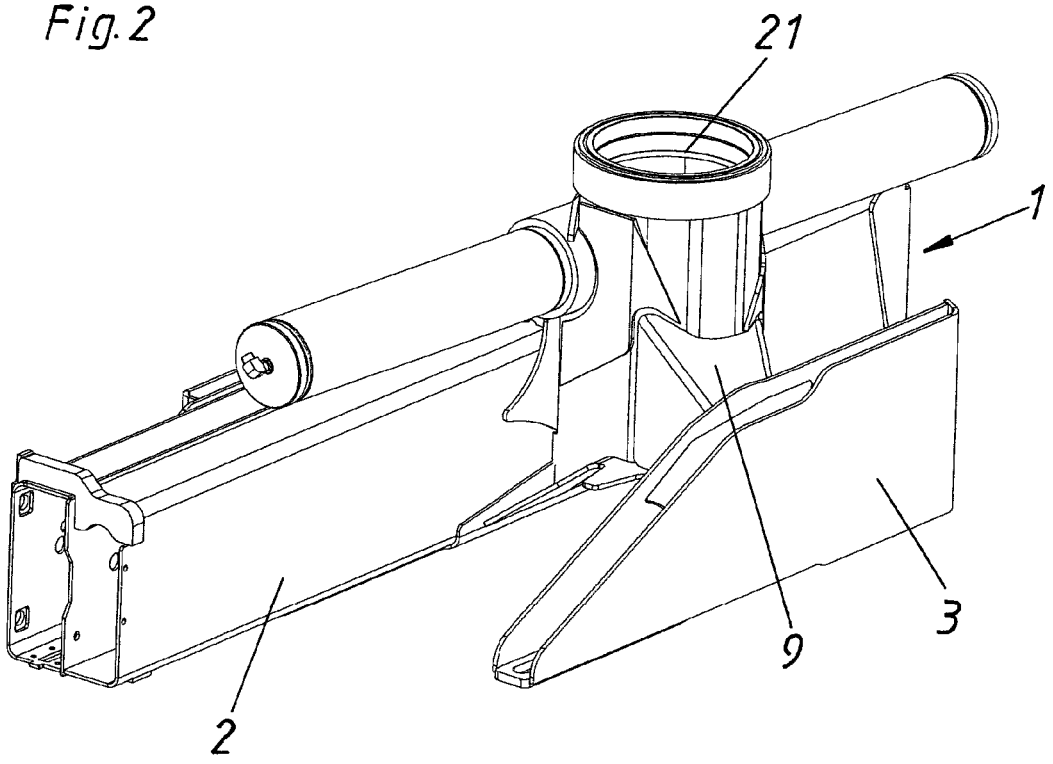
FIG. 2 shows a second solution according to the state of the art, which is statically indeterminate.

The profile cross-section belonging to that carrier 5 is shown in FIG. 4*d*. FIG. 4*e* shows an alternative. Independently of the form of the profile cross-section (here, an "I-profile"), the open configuration of the carrier 5 is important as the torsional flexibility is afforded thereby.

The invention claimed is:

1. A crane base for a loading crane comprising:

a base part having a mounting region for mounting a rotating part of the loading crane;

a support portion for supporting the crane base on a substructure; and a joint connecting the base part and the support portion together, the joint being a torsionally flexible carrier having an open cross-section with an I-profile, a first end of the carrier being directly attached to the base part and a second end of the carrier being directly attached to the support portion.

2. A loading crane comprising the crane base as set forth in claim 1.

3. A motor vehicle comprising a substructure, and the loading crane as set forth in claim 2 fixed to the substructure.

4. A motor vehicle comprising a substructure, and the crane base as set forth in claim 1 fixed to the substructure.

* * * * *